United States Patent [19]

Mantovan

[11] Patent Number: 4,552,007

[45] Date of Patent: Nov. 12, 1985

[54] DEVICE FOR REPLACING THE ROLLS OF ROLLING STANDS

[75] Inventor: Gianfranco Mantovan, Busto Arsizio, Italy

[73] Assignee: Pomini Farrel S.p.A., Castellanza, Italy

[21] Appl. No.: 615,838

[22] Filed: May 31, 1984

[30] Foreign Application Priority Data

Jun. 9, 1983 [IT] Italy ..... 22073/83[U]

[51] Int. Cl.[4] ..... B21B 31/10

[52] U.S. Cl. ..... 72/239; 72/237

[58] Field of Search ..... 72/239, 238, 237

[56] References Cited

U.S. PATENT DOCUMENTS 3,312,096 4/1967 Stubbs et al. ..... 72/238
4,368,633 1/1983 Nogota ..... 72/239
4,387,584 6/1983 Akita et al. ..... 72/239 X

FOREIGN PATENT DOCUMENTS 1961110 6/1971 Fed. Rep. of Germany ..... 72/238
2654560 6/1978 Fed. Rep. of Germany ..... 72/238
0156817 9/1982 Japan ..... 72/238

*Primary Examiner*—Lowell A. Larson
*Assistant Examiner*—Steven B. Katz
*Attorney, Agent, or Firm*—Morgan, Finnegan, Pine, Foley & Lee

[57] ABSTRACT

A device for replacing the rolls of rolling stands, comprising, on a base, a first carriage provided with at least one pair of seats able to receive a rolling stand, and a pair of carriages which are mobile in a direction normal to the first carriage and support the two stand housings. The first carriage is provided with a roll support which is adjustable and freely removable.

3 Claims, 5 Drawing Figures

DEVICE FOR REPLACING THE ROLLS OF ROLLING STANDS

This invention relates to a device used for rapidly replacing the rolls of rolling stands.

In continuous rolling mills it is known to replace the entire stand in the case of roll wear or fracture by simply disconnecting the motion transmission spindles and the systems which fix the stand into the rolling mill.

The stand, after being replaced and now ready for overhaul, is moved into a maintenance and fitting department in which by means of a series of well known operations it is perfectly prepared for further use and is then inserted into the working zone.

Said operations require special auxiliary equipment and hoists, and also involve a certain danger and a considerable loss of time. The object of the present invention is to obviate said drawbacks by allowing rapid and simple replacement of the stand rolls and eliminating a large part of the component danger to the operators. This object is attained according to the present invention by a device for replacing the rolls of rolling stands, characterised by comprising, on a base, a first carriage provided with at least one pair of seats able to receive a rolling stand, and a pair of carriages which are mobile in a direction normal to the first carriage and support the two stand housings, said first carriage being provided with roll support means, said means being adjustable and freely removable.

The operational and structural characteristics and the advantages of a device according to the invention will be more apparent from the description given hereinafter with reference to the accompanying diagrammatic drawings in which.

Figure 1:
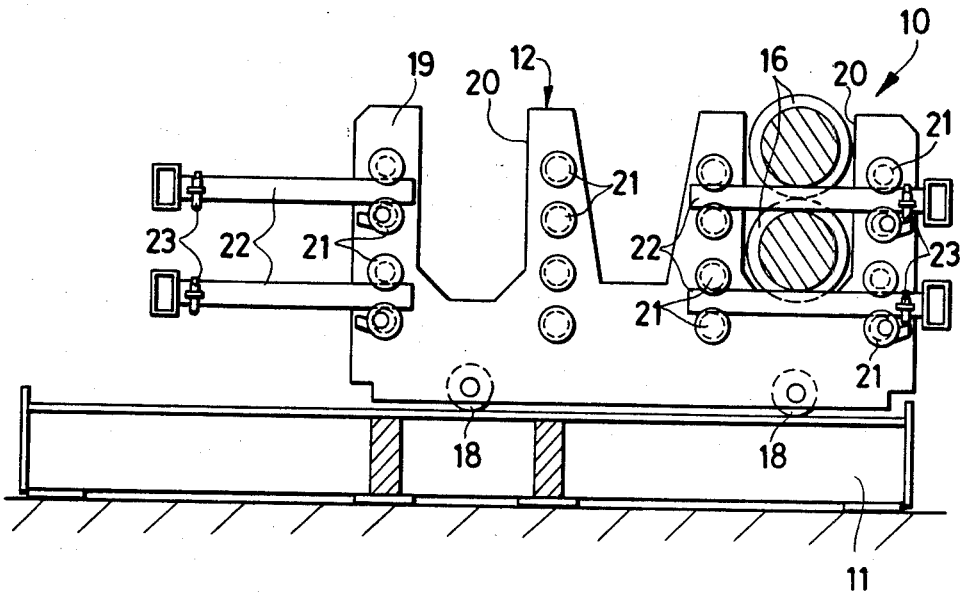
FIG. 1 is a side elevational view of a device according to the invention carrying a pair of new rolls.

With reference to the drawings, a device for replacing the rolls of rolling stands, which is indicated overall by the reference numeral 10, is composed of a base 11 on which there slide a carriage 12 and, in a direction normal thereto, two carriages 13 carrying two housings 14 and 15 which together with a pair of rolls 16 form a rolling stand 17.

The carriage 12, provided with wheels 18, is formed from two side walls 19 or shoulders which each comprise two U-shaped seats 20 able to receive at least one pair of rolls 16.

Pairs of guiding supports 21 are positioned to the sides of the seats 20 and receive bars 22 for supporting the necks of the rolls 16 and provided with a regulator device 23, for example in the form of a screw and cam acting on one of the supports 21.

The two carriages 13, provided with wheels 18, slide on guiding bases 24 which are normal to the main base 11 and are disposed in an intermediate zone thereof.

The housings 14 and 15 support the chocks and screw-down assemblies for the rolls with their relative drive (indicated schematically in the figures).

The operation and use of a device according to the invention are as follows:

It is required to replace the rolling rolls 16 disposed in a stand 17.

For this purpose, the stand 17 is moved into a suitable zone containing a device 10 constructed in accordance with the invention and arranged as shown in FIG. 1.

The entire stand 17 is inserted into the two free seats 20 in the side walls 19 of the carriage 12. The support bars 22 are then positioned in the pairs of guiding supports 21, and the necks of the worn cylinders 16 are made to rest on said bars 22 (FIG. 2), if necessary by adjusting the regulator devices 23.

Figure 3:
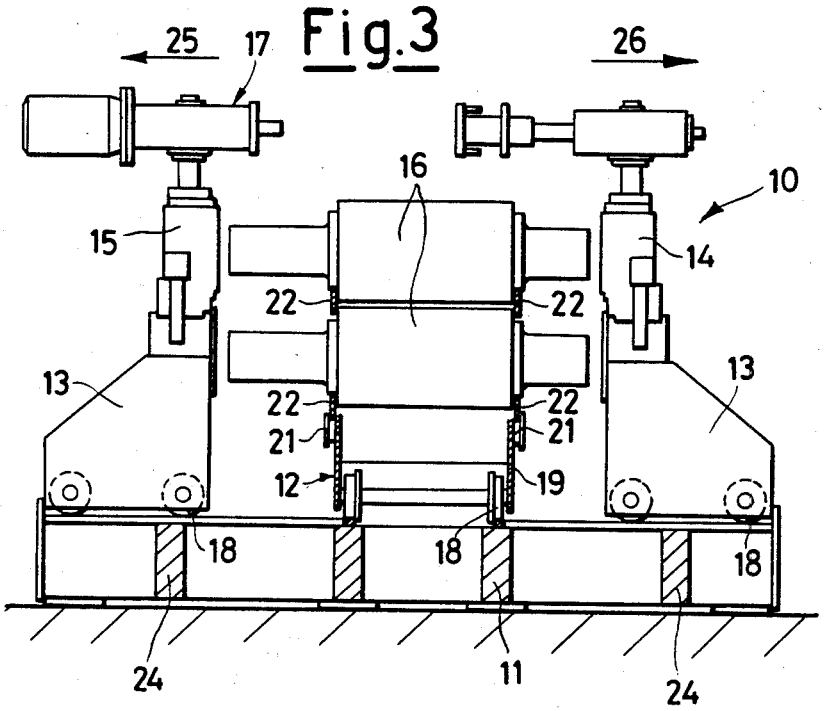
FIG. 3 is a front elevational view sectioned on the line III—III of FIG. 2.

The two housings 14 and 15 of the stand 17 are withdrawn from the rolls 16 by sliding their two supporting carriages 13 along the bases 24 in the direction of the arrows 25, 26 of FIG. 3, after having disconnected couplings or any other connection elements between the screw-down assemblies.

Figure 2:
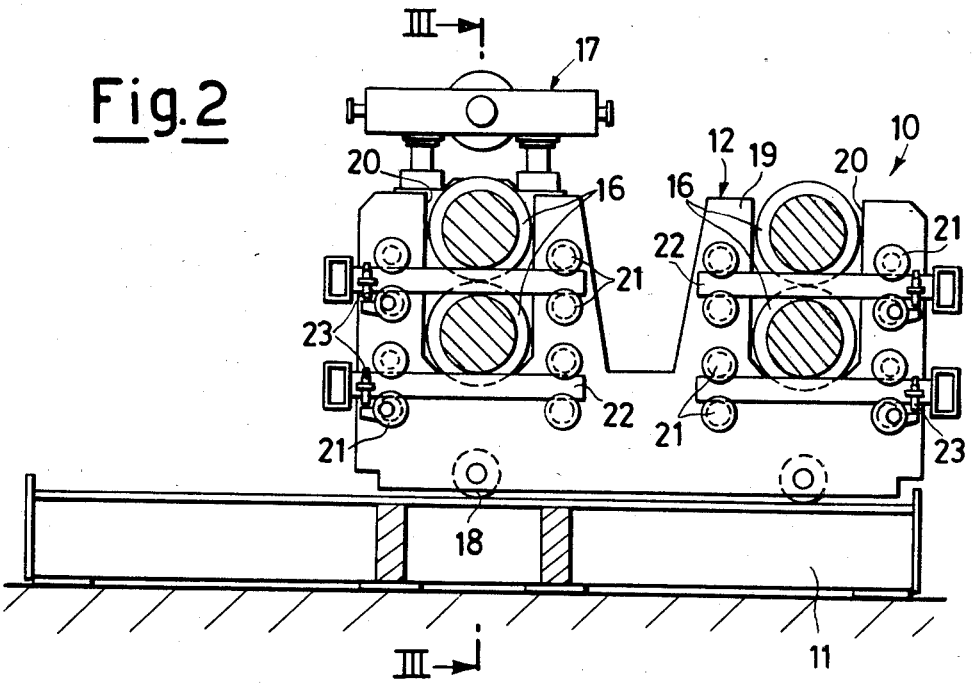
FIG. 2 is a side elevational view of the device of FIG. 1 carrying an inserted stand.
Figure 4:
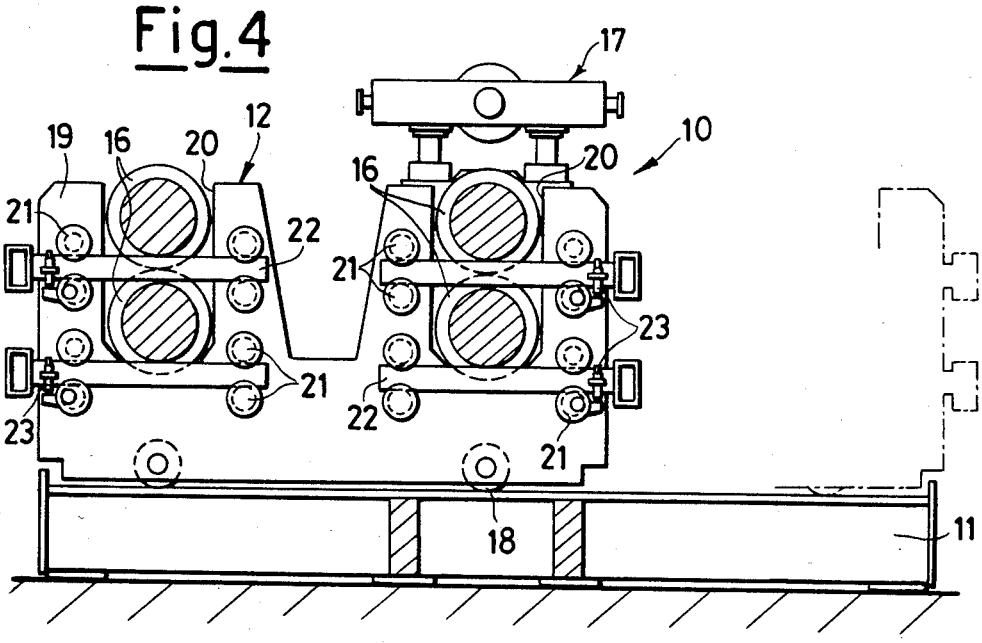
FIG. 4 is a side view similar to that of FIG. 2 but in a different stage of operation.

The carriage 12 is then moved from its position of FIG. 2 to that of FIG. 4, so removing the pair of worn rolls 16 and moving the pair of new rolls into positions corresponding with the stand housings 14 and 15.

Figure 5:
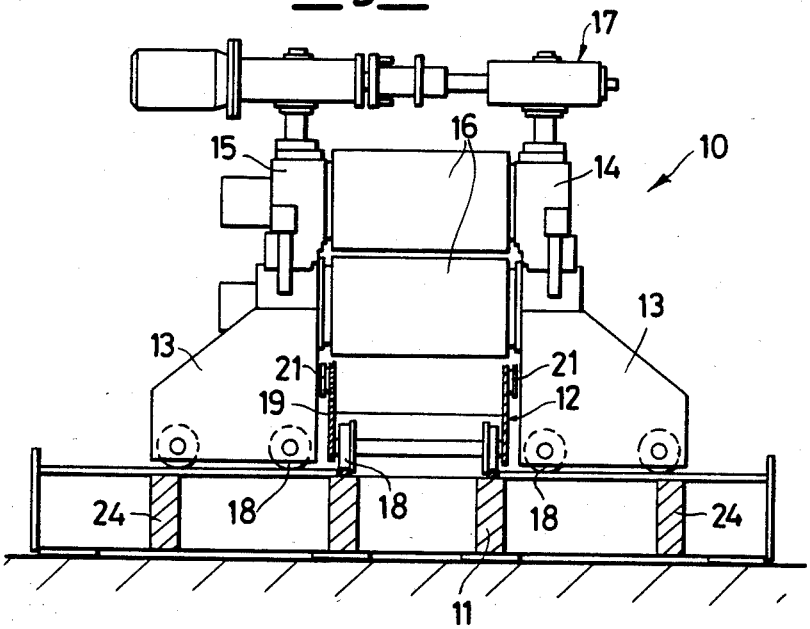
FIG. 5 is an elevational view similar to that of FIG. 3 but in a different stage of operation.

By now sliding the carriages 13 in the reverse direction to the arrows 25 and 26, the two housings 14 and 15 carrying the chocks become mounted over the necks of the new rolls 16, and the couplings are then reconnected to all the other previously disconnected parts (FIG. 5).

The overhauled stand 17 can then be completely released from its support carriages 12 and 13 by extracting the bars 22 from the pairs of guiding supports 21, possibly after slackening the regulator devices 23.

By this means, the rolls of a rolling stand can be replaced in a truly rapid and simple manner, without the use of hoists or special equipment, and under conditions of high safety for the operators.

I claim:

1. A device for replacing the rolls of rolling stands comprising:

a base;

a first carriage, which is mounted for movement along said base in a first path, having at least first and second seats for receiving first and second pairs of rolls whose axes are perpendicular to the first path, and having means for supporting said pairs of rolls;

a second carriage supporting one end of a roll stand housing, which is mounted for movement along said base in a second path perpendicular to the path of said first carriage, for receiving one end of said pairs of rolls; and a third carriage supporting the other end of said roll stand housing, which is mounted for movement along said base in a third path perpendicular to the path of said first carriage and aligned with the second path, for receiving the other end of said pairs of rolls;

whereby said second and third carriages with their respective roll stand housings ends are detached from the first pair of rolls and moved along the second and third paths away from said first carriage, said first carriage is moved along the first path to align said second pair of rolls with said second and third carriages, and said second and third carriages are moved back along the second and third paths to receive said second pair of rolls.

2. A device according to claim 1 wherein the seats include U-shaped apertures in the sides of said first carriage.

3. A device according to claim 2 wherein said means for supporting said pairs of rolls include a plurality of elongated bars which are mounted for sliding adjustment vertically and longitudinally.

* * * * *